US005787818A

United States Patent [19]

Letersky

[11] Patent Number: 5,787,818

[45] Date of Patent: Aug. 4, 1998

[54] METHOD OF PLACING A SHELF IN A STORAGE COMPARTMENT

[76] Inventor: Carolyn Letersky, Box 753, Grande Prairie, Alberta, Canada, T8V 3R5

[21] Appl. No.: 149,844

[22] Filed: Nov. 9, 1993

[30] Foreign Application Priority Data

Nov. 10, 1992 [CA] Canada ..... 2,082,581

[51] Int. Cl.[6] ..... A47B 3/00

[52] U.S. Cl. ..... 108/180; 108/153.1

[58] Field of Search ..... 108/180, 186, 108/185, 187, 153, 33, 41, 162, 168, 166

[56] References Cited

U.S. PATENT DOCUMENTS

| | | | |
|---|---|---|---|
| 2,919,815 | 1/1960 | Mairs et al. | 108/165 |
| 3,872,475 | 3/1975 | Silver | 108/162 X |
| 4,134,628 | 1/1979 | Mann | 108/180 X |
| 4,262,605 | 4/1981 | Sokol | 108/180 X |
| 4,324,076 | 4/1982 | Honickman | 108/180 X |
| 4,519,318 | 5/1985 | Weldon-Ming | 108/33 |
| 4,651,651 | 3/1987 | Sheffer | 108/180 |
| 4,942,830 | 7/1990 | Macaluso et al. | 108/162 |
| 4,949,853 | 8/1990 | Klein et al. | 108/180 X |
| 5,138,986 | 8/1992 | Rushbrooj et al. | 108/180 X |
| 5,315,936 | 5/1994 | Smith | 108/165 |

FOREIGN PATENT DOCUMENTS

| | | | |
|---|---|---|---|
| 444924 | 10/1912 | France | 180/162 |

*Primary Examiner*—Jose V. Chen

*Attorney, Agent, or Firm*—Anthony R. Lambert

[57] ABSTRACT

A method of placing a shelf in a storage compartment, consisting of the following described steps. Firstly, select a pair of shelf members having opposed ends. The distance between the opposed ends is substantially equal to the distance between interior sidewalls of the storage compartment. Secondly, select a pair of support members having opposed ends. The distance between the opposed ends corresponds to a desired shelf height. Thirdly, pivotally connect adjacent opposed ends of the shelf members and the support members to form a parallelogram frame. Fourthly, collapse the parallelogram frame to permit insertion into the storage compartment. Fifthly, bring the support members into engagement with the interior sidewalls of the storage compartment thereby orienting the shelf members perpendicular to the support members, with the interior sidewalls of the storage compartment providing lateral support.

1 Claim, 3 Drawing Sheets

METHOD OF PLACING A SHELF IN A STORAGE COMPARTMENT

The present invention relates to a method of placing a shelf in a storage compartment.

BACKGROUND OF THE INVENTION

In schools, each student is assigned a storage compartment, commonly known as a "locker". These lockers are arranged in rows, with an interior sidewall of one locker also serving as an interior sidewall of an adjacent locker. The lockers are elongate in shape, being approximately 12 inches in width, 10 to 24 inches in depth and 36 to 72 inches in height. Students are expected to keep their coats, books, and writing instruments in their assigned lockers. A problem presently being encountered is that, without shelving, the lockers are not well suited to the storage of books. The student is forced to either form a pile of books at the bottom of the locker, or affix some form of makeshift shelving within the locker.

The student placing some form of shelving within the locker is faced with numerous restrictions and problems. The school authorities do not wish the shelves affixed in such a manner that they cannot be readily removed, without damage to the locker, at the end of the school term. Hooks and rotatable fasteners which are conventional means for attaching a shelf project into and interfere with the use of the adjacent locker. Adhesive strips are severely limited in their weight bearing capacity. Each locker has a pair of coat hooks. Shelves can be suspended with wires from the coat hooks, but this arrangement does not have much lateral stability, the wires can interfere with use of the locker, and the weight bearing capacity of the wires and hooks is limited.

SUMMARY OF THE INVENTION

What is required is a more satisfactory means of placing shelves within a locker without causing damage or interfering with the use of the adjacent locker.

According to this aspect of the invention there is provided a method of placing a shelf in a storage compartment, which is comprised of the following described steps. Firstly, select a pair of shelf members having opposed ends. The distance between the opposed ends is substantially equal to the distance between interior sidewalls of the storage compartment. Secondly, select a pair of support members having opposed ends. The distance between the opposed ends corresponds to a desired shelf height. Thirdly, pivotally connect adjacent opposed ends of the shelf members and the support members to form a parallelogram frame. Fourthly, collapse the parallelogram frame to permit insertion into the storage compartment. Fifthly, bring the support members into engagement with the interior sidewalls of the storage compartment thereby orienting the shelf members perpendicular to the support members, with the interior sidewalls of the storage compartment providing lateral support.

With the method as described any number of parallelogram frames may be stacked upon each other to provide the shelving configuration desired. The spacial separation between the shelf members is maintained by the support members. The lateral support of the shelf members is provided by the interior sidewalls of the storage compartment; the self members are confined, there is no room for the shelf members to move laterally.

Although beneficial effects may be obtained through the use of the method as described, in order to reduce cost it is desirable to construct the shelving out of cardboard, rather than more expensive materials such as metal, wood or polymer plastic. When the shelf is constructed out of cardboard, the amount of weight imposed from above can be of concern. Even more beneficial results may, therefore, be obtained by including the further step of positioning a brace member intermediate the support members. The brace member has a first end engaging one of the shelf members and a second end engaging the other of the shelf members, thereby enhancing the weight bearing capacity of the shelf members.

According to another aspect of the invention there is provided a shelf for a storage compartment which is comprised of a pair of shelf members and a pair of support members. Each of the shelf members is of equal length and has opposed ends. Each of the support members is of equal length and has opposed ends. Adjacent opposed ends of the shelf members and the support members are pivotally connected thereby forming a parallelogram frame.

Although beneficial results may be obtained through the use of the shelf as described, even more beneficial results may be obtained by having a brace member positioned intermediate the support members. The brace member has a first end engaging one of the shelf members and a second end engaging the other of the shelf members, thereby enhancing the weight bearing capacity of the shelf members.

The preferred means of engagement between the brace member and the shelf members is a "T" shaped slotted opening extending inwardly from a peripheral edge of each of the shelf members. The brace member is generally "T" shaped with cross-members at each of the first end and the second end. The cross-members engage the slotted openings of the shelf members to removably secure the brace member to the shelf members.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 2:
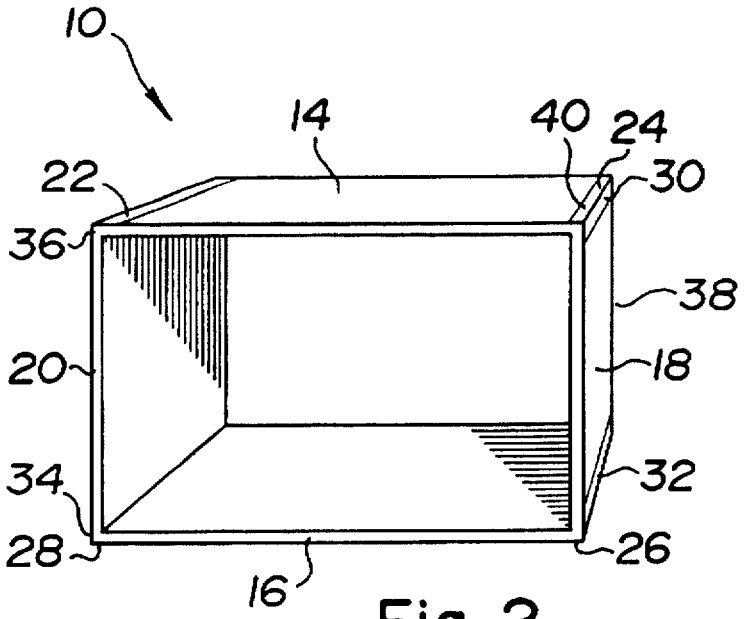
FIG. 2 is perspective view of a first embodiment of a shelf constructed in accordance with teachings of the present invention.
Figure 3:
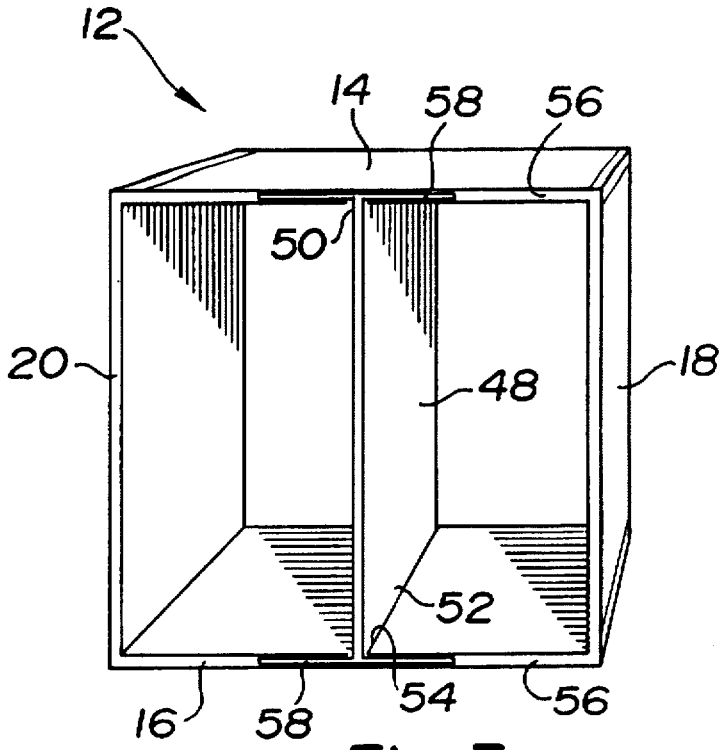
FIG. 3 is perspective view of a second embodiment of a shelf constructed in accordance with teachings of the present invention.
Figure 4:
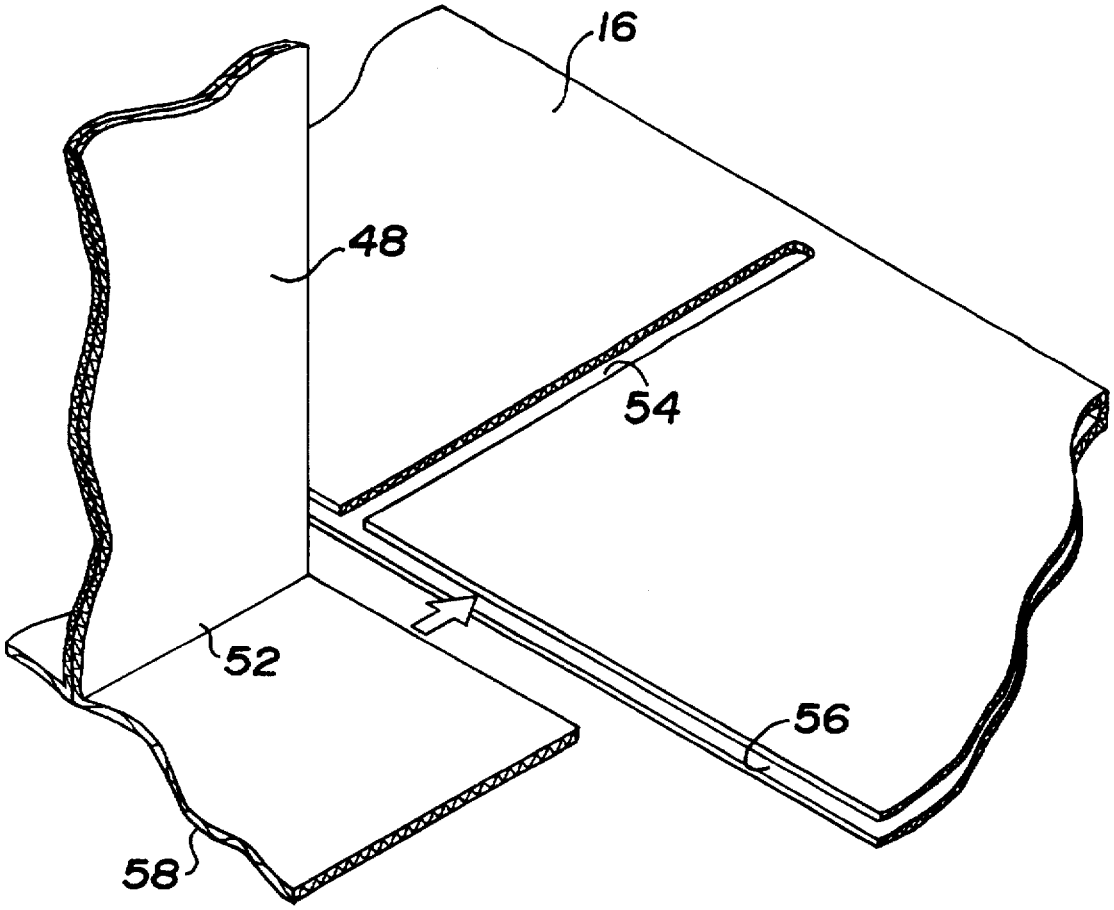
FIG. 4 a detailed view of the shelf illustrated in FIG. 3.

The method of placing a shelf in a storage compartment will now be described with reference to FIGS. 1 through 3. There will also be described two embodiments of a shelf adapted for placement within a storage compartment in accordance with the described method. A first embodiment of a shelf, generally identified by reference numeral 10, is illustrated in FIG. 2. A second embodiment of a shelf, generally identified by reference numeral 12 is illustrated in FIG. 3.

Referring to FIG. 2, shelf 10 consists of a pair of shelf members 14 and 16 and a pair of support members 18 and 20. Shelf members 14 and 16 are of equal length. Shelf member 14 has opposed ends 22 and 24. Shelf member 16 has opposed ends 26 and 28. Similarly, support members 18 and 20 are of equal length. Support member 18 has opposed ends 30 and 32. Support member 20 has opposed ends 34 and 36. Adjacent opposed ends of shelf members 14 and 16 and support members 18 and 20 are pivotally connected thereby forming a parallelogram frame, generally identified by reference numeral 38. End 24 of shelf member 14 is pivotally connected to end 30 of support member 18. End 32 of support member 18 is pivotally connected to end 26 of shelf member 16. End 28 of shelf member 16 is pivotally connected to end 34 of support member 20. End 36 of support member 20 is pivotally connected to end 22 of shelf member 14. Although shelf members 14 and 16 and the support members 18 and 20 can be constructed of metal, wood or polymer plastic; it is preferred that cardboard be used to reduce expense. Although there are a variety of hinge means available for pivotally connecting the adjacent opposed ends of shelf members 14 and 16 and support members 18 and 20, it is preferred that the cardboard material be folded to form a "living" hinge along the fold line. The cardboard must be joined together at some point and this is done using a strip of tape, generally identified by reference numeral 40.

The use of shelf 10 will now be described with reference to the preferred method. Parallelogram frame 38 does not have lateral stability, and must be especially "sized" to suit a particular size of storage compartment. In the description which follows shelf 10 will be described in relation to a storage compartment in the form of a locker, generally identified by reference numeral 42 and illustrated in FIG. 1. Locker 42 has interior sidewalls 44 and 46. In constructing parallelogram frame 38 to suit locker 42 certain steps must be followed. Firstly, shelf members 14 and 16 must be selected of an appropriate length. The distance between opposed ends 20 and 24 of shelf member 14, and the distance between opposed ends 26 and 28 of shelf member 16 must be substantially equal to the distance between interior sidewalls 44 and 46 of locker 42. Secondly, support members 18 and 20 must be selected of an appropriate length. The distance between opposed ends 30 and 32 of support member 18 and the distance between opposed ends 34 and 36 of support member 20 must correspond to a desired shelf height. Of course, the desired shelf height will vary depending upon the purpose of the shelving unit. Thirdly, adjacent opposed ends of shelf members 14 and 16 and support members 18 and 20 must be pivotally connected to form parallelogram frame 38. Lockers such as locker 42 always have a peripheral lip (not shown) upon which a door (not shown) is mounted. Parallelogram frame 38 will not fit through the door unless collapsed. Fourthly, collapse parallelogram frame 38 to permit insertion into locker 42. Fifthly, bring support members 18 and 20 into engagement with interior sidewalls 44 and 46 of locker 42 with support member 18 resting parallel to interior sidewall 44 and support member 20 resting parallel to interior sidewall 46. When in this position, shelf members 14 and 16 are perpendicular to support members 18 and 20, with interior sidewalls 44 and 46 of locker 42 providing lateral support.

Figure 1:
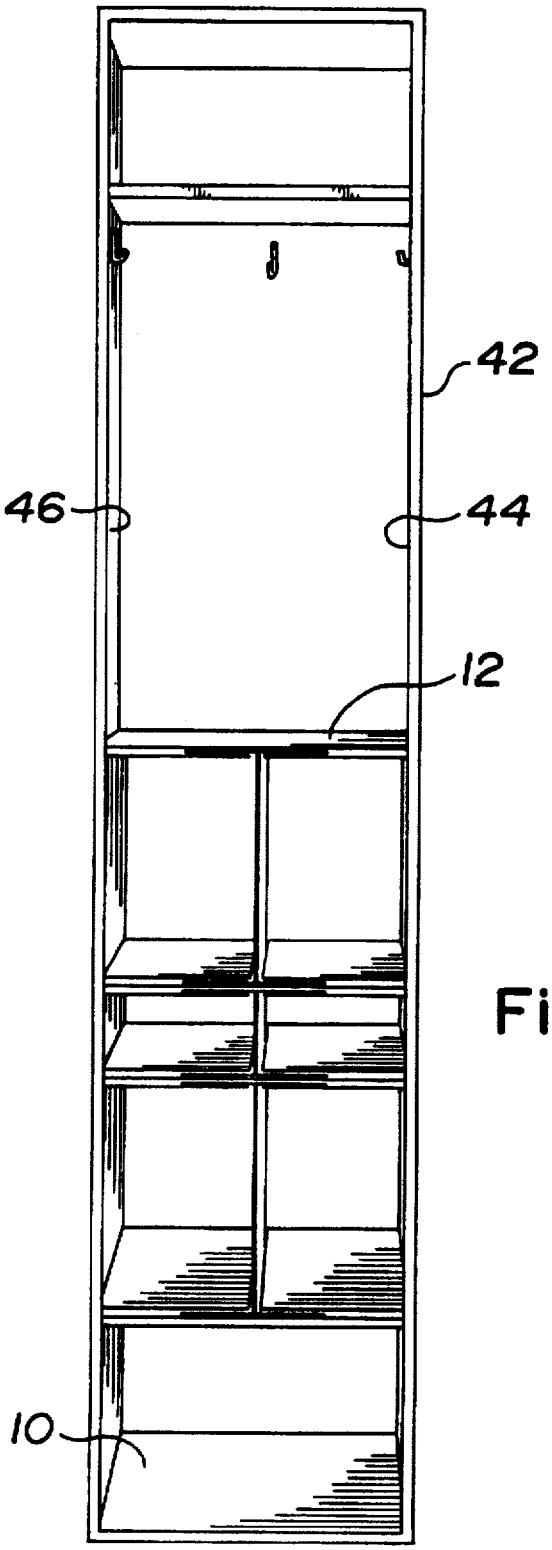
FIG. 1 is a front elevation view of a locker with shelving affixed in accordance with the teachings of the method which forms part of the present invention.

It will be apparent from FIG. 1, that by stacking a plurality of parallelogram frames 38 of varying sizes within locker 42 a wide variety of shelving configurations can be constructed. However, with shelf 10 constructed out of cardboard, the amount of weight imposed from above can be of concern. This concern has been addressed in shelf 12 which is the second embodiment illustrated in FIG. 3. Referring to FIG. 3, an brace member 48 is used to enhance the weight bearing capacity of shelf members 14 and 16. Brace member 48 is positioned intermediate support members 18 and 20. Brace member 48 has a first end 50 engaging shelf member 14 and a second end 52 engaging shelf member 16. Various means of engagement between brace member 48 and shelf members 14 and 16 can be used. The preferred means of engagement will now be described. A "T" shaped slotted opening 54 extends inwardly from a peripheral edge 56 of each of shelf members 14 and 16. "T" shaped slotted opening 54 extends almost completely across shelf members 14 and 16. Brace member 48 is generally "T" shaped with cross-members 58 at each of first end 50 and second end 52. Cross-members 58 engage slotted openings 54 of shelf members 14 and 16 to removably secure brace member 48 to shelf members 14 and 16. It is preferred that slotted opening 54 be slightly larger than cross-members 58 in order to provide some room for movement to permit parallelogram frame 38 to be partially collapsed for insertion into locker 42 without having to remove brace member 48. It is also preferred that brace member 48 be made of cardboard and folded to form a double walled central support.

It will be apparent to one skilled in the art that modifications may be made to the illustrated embodiments without departing from the spirit and scope of the invention as defined by the claims.

The embodiments of the invention in which an exclusive property or privilege is claimed are defined as follows:

1. In combination:

a locker-style storage compartment having interior side walls: and a shelf unit for a storage compartment, comprising:

a. a pair of shelf members, each of the shelf members being of equal length and having opposed ends; and b. a pair of support members, each of the support members being of equal length and having opposed ends, adjacent opposed end of the shelf members and the support members being pivotally connected thereby forming a laterally unstable collapsible parallelogram frame, a brace member being positioned intermediate the support members, the brace member having a first end engaging one of the shelf members and a second end engaging the other of the shelf members, thereby enhancing the weight bearing capacity of the shelf members;

the shelf unit being collapsible for insertion into the locker-style storage compartment, with the support members and the opposed end of the shelf members engaging the interior sidewalls to provide lateral stability to the parallelogram frame, each of the shelf members having a "T" shaped slotted opening extending inwardly from a peripheral edge, the brace member being generally "T" shaped with cross-members at each of the first end and the second end, the cross-members engaging the slotted openings of the shelf members to removably secure the brace member to the shelf members, the slotted openings being slightly larger than the cross-members thereby permitting the parallelogram frame to be partially collapsed.

* * * * *